US007298333B2

(12) United States Patent
Iluz et al.

(10) Patent No.: US 7,298,333 B2
(45) Date of Patent: Nov. 20, 2007

(54) PATCH ANTENNA ELEMENT AND APPLICATION THEREOF IN A PHASED ARRAY ANTENNA

(75) Inventors: Zeev Iluz, Gan-Yavne (IL); Reuven Bauer, Rehovot (IL)

(73) Assignee: Elta Systems Ltd., Ashdod (IL)

( * ) Notice: Subject to any disclaimer, the term of this patent is extended or adjusted under 35 U.S.C. 154(b) by 34 days.

(21) Appl. No.: 11/296,569

(22) Filed: Dec. 8, 2005

(65) Prior Publication Data

US 2007/0132642 A1 Jun. 14, 2007

(51) Int. Cl.
*H01Q 1/38* (2006.01)

(52) U.S. Cl. ..... 343/700 MS; 343/846

(58) Field of Classification Search ..... 343/700 MS, 343/846, 789

See application file for complete search history.

(56) References Cited

U.S. PATENT DOCUMENTS

| | | | | |
|---|---|---|---|---|
| 3,877,031 | A | 4/1975 | Mailloux et al. | |
| 4,021,812 | A | 5/1977 | Schell et al. | |
| 5,006,857 | A | 4/1991 | DeHart | |
| 6,067,048 | A | 5/2000 | Yamada | |
| 7,158,086 | B2 * | 1/2007 | Inatsugu et al. | 343/711 |
| 2003/0020655 | A1 * | 1/2003 | McKinzie et al. | 343/700 MS |
| 2006/0232470 | A1 * | 10/2006 | Mallick | 342/386 |

FOREIGN PATENT DOCUMENTS

EP 0 892 461 A 1/1999

OTHER PUBLICATIONS

Frank Zavosh et al., "Infinite Phased Arrays of Cavity-Backed Patches", *IEEE Transactions On Antennas And Propagation*, vol. 42, No. 3, pp. 390-398, Mar. 1, 1994. XP000440790.

Jui-Ching Cheng et al., "Theoretical Modeling of Cavity-Backed Patch Antennas Using a Hybrid Technique", *IEEE Transactions On Antennas And Propagation*, vol. 43, No. 9, pp. 1003-1013, Sep. 1, 1995. XP000522593.

* cited by examiner

*Primary Examiner*—Hoang V. Nguyen
(74) *Attorney, Agent, or Firm*—Browdy and Neimark, PLLC

(57) ABSTRACT

A method of suppressing grating lobes generated in a radiating pattern of a phased array antenna, and a patch antenna element for use in the phased array antenna are described. The phased array antenna is formed from a plurality of symmetrical patch antenna elements spaced apart at a predetermined distance from each other. Each patch antenna element is configured for producing an asymmetrical radiation pattern. The antenna element includes a conductive ground plane, a radiating patch backed by a cavity and arranged in cavity aperture, and a feed arrangement. The patch antenna element is configured such that a dimension of the radiating patch along the E-plane of the antenna element is less than the dimension of the cavity aperture by a first predetermined value selected to provide an asymmetrical radiation pattern of the patch antenna element. To provide a required degree of the asymmetry of said radiation pattern, a dimension of the radiating patch along the H-plane should be less than the dimension of the cavity aperture along said H-plane by a second predetermined value.

20 Claims, 7 Drawing Sheets

PATCH ANTENNA ELEMENT AND APPLICATION THEREOF IN A PHASED ARRAY ANTENNA

FIELD OF THE INVENTION

The present invention relates generally to directional beam forming antennas, and in particular, to a phased array antenna configuration for suppressing grating lobes.

BACKGROUND OF THE INVENTION

There are many applications employing antennas for transmitting and receiving electromagnetic signals in which the defining of antenna gain patterns with maximas for directional transmitting and receiving the signals is a desirable feature. One type of such antenna systems is the active transmit phased array having a plurality of individual antenna elements which are interconnected in ways designed to enable, for example, electronic steering of the radiated beams of electromagnetic energy in space, without physical movement of the whole array. The antenna elements can be distributed uniformly or non-uniformly over a prescribed surface area, and chosen to provide the desired antenna radiation characteristics. The surface may be planar or curved, in more than one plane, and the area's perimeter may be of any shape, e.g., circular, rectangular, or simply a straight line.

The antenna array can be used, for example, in a radar system for estimating the direction-of-arrival of a target. One way to obtain an antenna system with good direction finding ability is to increase angle resolution, for example, by narrowing the main lobe of the radiation pattern of the array. It is known that angle resolution is determined by the array size. For instance, the angular resolution becomes better when the number of the antenna elements is increased, while the distance between the antennas is fixed. However, the increase of the number of the antenna elements can significantly increase the cost of the system. In the limitation of cost, instead of increasing the number of antenna elements, increase of the distance between the antenna elements in the antenna array can also provide increase of the array size. The more separated the antenna elements are the more narrow the main lobe becomes, and thus the better direction finding ability of the system.

Another reason to increase distance between the antenna elements can be associated with the physical size of the antenna elements. In particular, if the wavelength of transmitted and/or received electromagnetic waves is in the millimeter to centimeter region, then it is difficult and sometimes impossible to make the distance between the elements smaller than half a wavelength.

However, the separation of the antenna elements, in an attempt to minimize the number of elements in the array, gives rise to grating lobes generated in the pattern of the radiated energy from the array in the directions other than the desired one. The grating lobes may appear on each side of the main lobe with decreasing amplitude the further away from the main lobe. The two grating lobes closest to the main lobe have the highest amplitude.

The grating lobes can appear in the range of the visible zone ($-90° < \theta < +90°$, where $\theta$ is the directional angle, i.e. the scanning angle from "boresight" towards "endfire") when the antenna elements are spaced apart at the distance more than half a wavelength. In radar applications, if the grating lobes are left in the visible zone as they are, it is not possible to distinguish between targets detected in the main beam and in the grating lobe beams, which results in ambiguities. A target detected in a grating lobe beam will be processed as if it had been received in the main beam, and will be assigned a completely erroneous spatial direction by the radar signal processor. Moreover, grating lobes carry some of the energy to unwanted spatial regions, and thus reduce the operating efficiency of the system.

It is thus desirable to eliminate the grating lobes from the visible zone or to adequately suppress the relative power of the grating lobes with respect to the main beam. For example, if the beam is electronically scanned from the normal towards the tangent to the array surface, in order to avoid the grating lobes in the scanning zone the maximum scan angle can be reduced from ninety degrees to a certain smaller value as the spacing between the antenna elements is greater than one half-wavelength. Thus, there is a trade-off between the maximum scan angle and the minimal distance between the antenna elements.

Various techniques are known in the art for suppressing relative power of grating lobes in an electronically scanned antenna array. One such type of scanned reflector antenna is disclosed in U.S. Pat. No. 3,877,031 to R. Mailloux et al. Grating lobe suppression is realized by adding odd mode power to the fundamental even mode power that normally drives each radiating element of the array. The odd mode power is maintained ±90 degrees out of phase with the even mode power at each radiating element aperture. The ratio of even mode power to odd mode power is varied as a function of main beam displacement from broadside to control the amount of grating lobe radiation.

Another method of grating lobe reduction is disclosed in U.S. Pat. No. 4,021,812 to A. Schell et al, which relates to suppression of side lobes and grating lobes in directional beam forming antennas by the use of a spatial filter. The filter consists of flat layers of high dielectric-constant material separated by air or other low dielectric-constant materials. The filter is placed directly over the antenna radiating aperture, and its dielectric materials have dielectric constant and thickness values that effect full transmission of beam power in a selected beam direction and substantial rejection of it in other directions so as to suppress side and grating lobes.

U.S. Pat. No. 6,067,048 to Yamada describes a radar apparatus comprising a transmitting antenna and a receiving antenna. The receiving antenna is an array having a plurality of antenna elements, wherein each antenna element includes a plurality of elemental antennas, so as to have a predetermined directional pattern. A synthetic pattern of the directional pattern of each antenna element and a directional pattern of the transmitting antenna has a depressed shape of relative power at an angle where a grating lobe of the receiving antenna appears.

There are applications of phased array antennas in which the scanning zone is not symmetrical with respect to the boresight. For example, for a radar system mounted on an aircraft and designed for steering a radiation beam towards the ground and sweeping the beam through a certain angle, scanning well ahead of the aircraft can sometimes be more important than the scanning behind the aircraft. Likewise, for a radar system mounted on a mast, the scanning in the elevation plane far away of the mast is usually more important than the scanning below the mast.

U.S. Pat. No. 5,006,857 to M. J. DeHart describes a planar microstrip antenna structure for a radar application, which permits the beam to sweep on greater angles from boresight in one direction than in another directions. The planar microstrip antenna structure has individual antenna elements in the form of asymmetrical triangular patches. Each of the antenna elements has a triangular shape with three angles and three sides. One of the angles is approximately 60 degrees. The side opposite the 60-degree angle, referred to as the "base," is sloped at an angle with respect to the perpendicular of the bisector of the 60-degree angle.

Having the base sloped at a selected angle less than 90 degrees provides an element pattern having a significant beam squint. Further, the element pattern remains within 6 decibels until 70 degrees from boresight. The beam of the array may thus be swept in a selected direction through angles until 70 degrees from boresight.

SUMMARY OF THE INVENTION

Despite the prior art in the area of directional beam forming antennas, there is still a need in the art for further improvement in order to provide a phased array antenna having a radiation pattern in which grating lobes are substantially suppressed or eliminated, while having spacings between antenna elements greater than one half-wavelength.

It would be advantageous to have a novel antenna element so that when such elements are used in a phased array antenna, grating lobes can be substantially suppressed or eliminated.

The present invention partially eliminates disadvantages of the prior art antenna techniques and provides a novel method of suppressing grating lobes generated in a radiating pattern of a phased array antenna constituted of a plurality of antenna elements spaced apart at a predetermined distance from each other. The predetermined distance between the patch antenna elements can be in the range of half-wavelength to one-wavelength.

The method is characterized by forming the phased array antenna from symmetrical antenna elements which have asymmetrical radiation patterns. Because the radiation pattern of the single antenna element is asymmetrical, the grating lobes which could appear in the entire array antenna pattern in the visible zone are mainly canceled outside of the region of the single element radiation pattern, owing to the multiplication of the array factor by the asymmetrical antenna element radiation pattern. This permits to extend a scanning angle of a steered energy beam of the phased array antenna in a selected direction from boresight towards endfire. For example, the phased array antenna of the present invention can be operable to scan within the range of $-35°<\theta<+55°$, where $\theta$ is the scanning angle from boresight towards endfire. This operational range defers from the range of $-40°<\theta<+40°$ of a conventional phased array antenna having the same configuration as the antenna of the present invention, but constituted of antenna elements having symmetrical patterns.

The aforementioned need is also achieved by providing a novel patch antenna element that includes a conductive ground plane having a cavity recessed therein, a radiating patch backed by the cavity and arranged in a cavity aperture, and a feed arrangement coupled to the radiating patch at a feed point located within the patch for providing radio frequency energy thereto.

A plane perpendicular to the patch and passing through a center of the radiating patch and the feed point defines an E-plane of the patch antenna element, whereas a plane perpendicular to the E-plane and passing through the feeding point defines an H-plane of the patch antenna element.

According to the invention, a dimension of the radiating patch along the E-plane is less than the dimension of the cavity aperture by a first predetermined value, whereas a dimension of the radiating patch along the H-plane is less than the dimension of the cavity aperture by a second predetermined value.

According to the invention, the radiating patch and the cavity aperture have a similar symmetrical shape. Examples of the symmetrical shape include, but are not limited to, rectangular shape, polygonal shape, circular shape and elliptical shape. Notwithstanding the fact that the entire patch antenna element of the present invention is symmetrical with respect to the E-plane, the relationship between the dimensions of the patch and cavity aperture specified above can provide a predetermined asymmetrical radiation pattern of the patch antenna element. For example, the gain of the predetermined asymmetrical radiation pattern can be decreased by less than 6 dB of its maximum value from boresight to a point 77° from boresight in a selected direction.

According to an embodiment of the invention, the radiating patch is formed on a dielectric substrate having an outer major side and an inner major side facing the conductive ground plane and supported thereon. The radiating patch can be formed either on the outer major side of the dielectric substrate or on the inner major side of the dielectric substrate.

According to another embodiment of the invention, the cavity recessed in the conductive ground plane is filled with a dielectric material. In such a case, the dielectric material is made of a solid material forming a substrate for supporting the radiating patch thereon.

According to one embodiment of the invention, the feed arrangement includes a vertical coaxial line having an inner conductor and an outer conductor. The inner conductor can be extended through an opening formed in the conductive ground plane and through the cavity, and connected to the radiating patch at the feed point. In turn, the outer conductor can be connected to the ground plane.

According to another embodiment of the invention, the feed arrangement includes a slot coupled feed line made through a slot arranged in said conductive ground plane at a bottom of the cavity.

According to still another embodiment of the invention, the feed arrangement includes a proximity coupled feed line. For example, the proximity coupled feed line can include a microstrip feed line arranged on the other major side of the dielectric substrate than the major side on which the radiating patch is formed.

According to an embodiment of the invention, the feed point is located at a position apart by a predetermined distance from the center of the patch along the E-plane.

When required, the patch antenna element can further comprise a protection radome formed on an outer radiating surface of the patch antenna element.

The patch antenna element of the present invention has many of the advantages of the prior art techniques, while simultaneously overcoming some of the disadvantages normally associated therewith.

The patch antenna element according to the present invention may be easily and efficiently manufactured.

The patch antenna element according to the present invention is of durable and reliable construction.

The patch antenna element according to the present invention may be relatively thin in order to be inset in the skin of a mounting platform without creating a deep cavity therein.

The patch antenna element according to the present invention may have a low manufacturing cost.

In summary, according to one broad aspect of the present invention, there is provided a method of suppressing grating lobes generated in a radiating pattern of a phased array antenna, the method comprising forming the phased array antenna from a plurality of symmetrical antenna elements spaced apart at a predetermined distance from each other, each producing an asymmetrical radiation pattern, the method thereby enabling to extend a scanning angle of a steered energy beam of said phased array antenna.

According to another general aspect of the present invention, there is provided an patch antenna element comprising: a conductive ground plane having a cavity recessed therein and defining a cavity aperture, a radiating patch backed by the cavity and arranged in the cavity aperture, and a feed arrangement coupled to the radiating patch at a feed point located within the patch and operable to provide radio frequency energy thereto;

a plane perpendicular to the patch and passing through a center of the radiating patch and the feed point defining an E-plane of said patch antenna element, and a plane perpendicular to the E-plane and passing through the feeding point defining an H-plane of said patch antenna element; the patch antenna element being configured such that a dimension of the radiating patch along the E-plane is less than the dimension of the cavity aperture by a first predetermined value selected to provide an asymmetrical radiation pattern of said patch antenna element.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

DETAILED DESCRIPTION OF SPECIFIC EMBODIMENTS

Figure 1A:
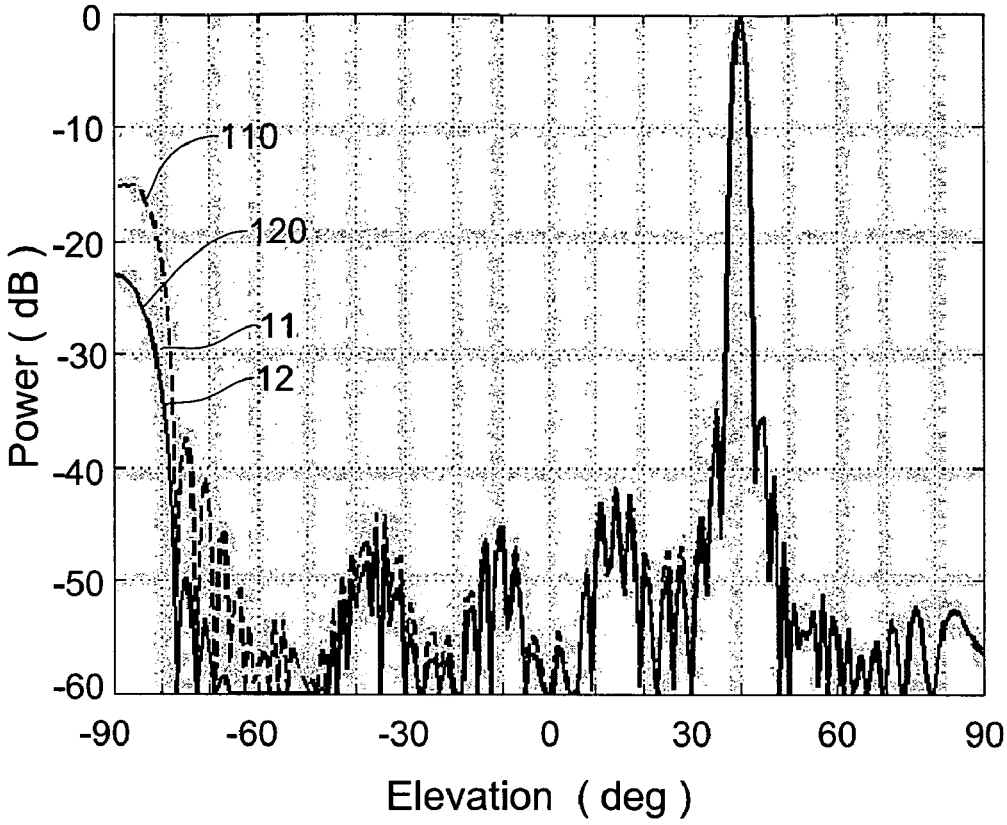
FIG. 1A illustrates exemplary patterns of phased array antennas constituted of linear arrays of identical antenna elements having symmetrical and asymmetrical radiation patterns, respectively.

The principles and operation of an antenna array structure according to the present invention may be better understood with reference to the drawings and the accompanying description. It being understood that these drawings are given for illustrative purposes only and are not meant to be limiting. The same reference numerals and alphabetic characters will be utilized for identifying those components which are common in the antenna array structure and its components shown in the drawings throughout the present description of the invention.

According to the phased array radiation theory, due to the array pattern multiplication property, a vector of the total radiation pattern $E_{tot}(k)$ of an array of identical antenna elements in the far-field approximation can be obtained by $E_{tot}(k)=F(k)A(k)$, where $k=2\pi r/\lambda$ is the wave vector, r is the unit vector in the direction of a certain point in space having coordinates $(R, \theta, \phi)$, $\lambda$ is the wavelength; the factor F(k) is related to a radiation pattern of a single antenna element, and A(k) is the array factor which incorporates all the translational phase shifts and relative weighting coefficients of the array elements.

It should be appreciated that the radiation pattern of a single antenna element F(k) defines an envelope within which the steered beam of the array of the antenna elements can be swept. In particular, the total antenna array radiation pattern $E_{tot}(k)$ may extend to the edge of the envelope, but may not exceed the envelope's region. The present invention teaches to use this feature in order to extend the scanning angle of the steered beam, owing to reducing, suppressing or eliminating grating lobes in the array pattern, without decrease of the distance between the antenna elements. According to the invention, the scanning angle can be substantially extended while maintaining the element spacing within the range of half-wavelength to one-wavelength.

Referring now to the drawings, FIG. 1A illustrates exemplary schematic patterns 11 and 12 of phased array antennas scanned to +40° constituted of linear arrays of identical antenna elements spaced apart at 0.6λ and having symmetrical and asymmetrical radiation patterns (not shown), respectively. A degree of asymmetry of the element radiation patterns is 15°. According to this example, grating lobes 110 and 120, which have correspondingly the levels of −17 dB and −23 dB, can be observed at −90° on the radiation patterns of the phased array antennas constituted of symmetrical pattern antenna elements and asymmetrical pattern antenna elements, respectively. As can be seen, an amplitude of the grating lobe 110 is smaller than the amplitude of the grating lobe 120, owing to the multiplication of the array factor by the asymmetrical radiation pattern of the antenna elements rather than by the symmetrical pattern.

Figure 1B:
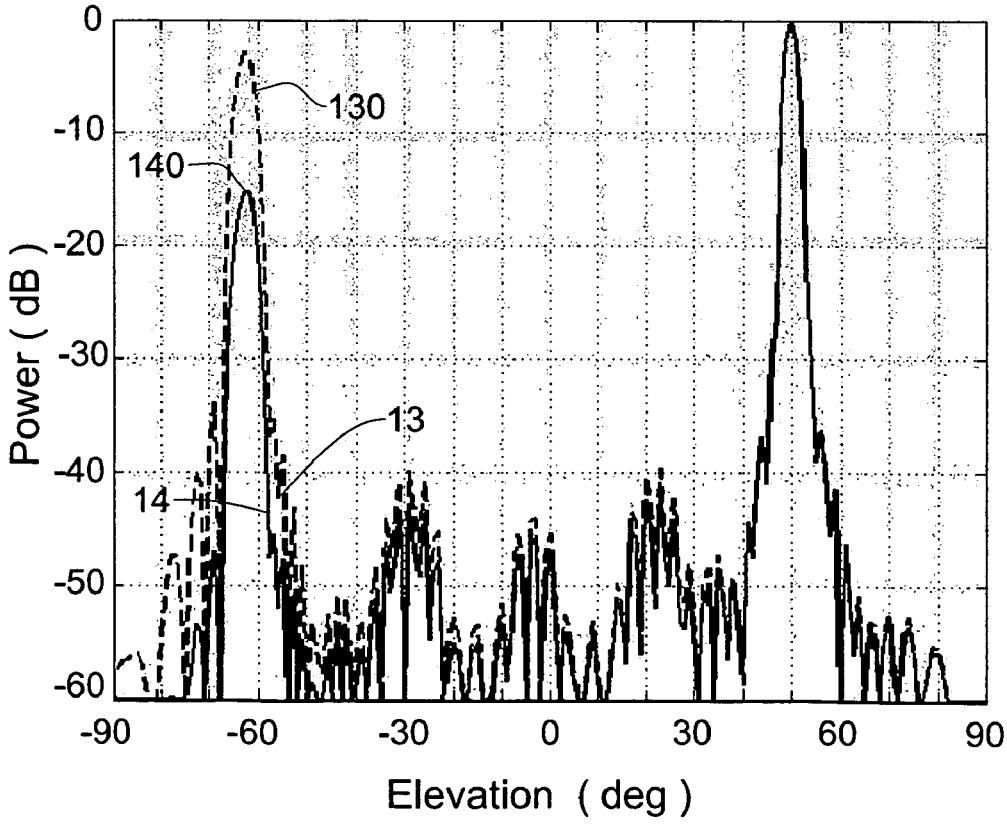
FIG. 1B illustrates other exemplary patterns of phased array antennas constituted of linear arrays of identical antenna elements having symmetrical and asymmetrical radiation patterns, respectively.

FIG. 1B illustrates exemplary schematic patterns 13 and 14 for the phased array antennas described above with reference to FIG. 1A, which are scanned now to +50°. In this case, grating lobes 130 and 140 appear in the visible zone of the radiation patterns at −62°, corresponding to the array antennas constituted of the antenna elements having symmetric and asymmetric radiation patterns, respectively.

The amplitude level of the grating lobe 130 is −3 dB, while amplitude level of the grating lobe 140 is −17 dB. As can be understood, in the case when the element pattern is symmetrical, the grating lobe 130 has a relatively significant value that can be sufficient for reducing the operating efficiency of the phased array antenna. On the other hand, when the element pattern is asymmetrical, the amplitude of the grating lobe has a suppressed magnitude.

The inventors have found that magnitude of the peak of the grating lobes on the resulting array radiation pattern depends on the rate of asymmetry of the single element pattern. For example, to suppress the grating lobes for the antenna array having about 0.6λ spacing between the antenna elements, the single element pattern can be within the range of $-50° < \theta < +77°$ at the level where the gain does not drop from its maximal value greater than 6 dB. It should be understood that such a range can be extended by decreasing the spacing between the antenna elements.

The concept of suppressing the grating lobes by employing antenna elements having asymmetrical radiation pattern is not bound by any specific type or configuration of the antenna elements. An example of the antenna elements suitable for the purpose of the present invention includes, but is not limited to, the patch antenna element described in U.S. Pat. No. 5,006,857, the disclosure of which is incorporated hereby by reference into this description. As indicated above in the background section, the antenna element disclosed in U.S. Pat. No. 5,006,857 has an asymmetrical shape that results in an asymmetrical element radiation pattern.

Contrary to U.S. Pat. No. 5,006,857, the present invention provides an antenna element having a symmetrical shape, which also produces an asymmetrical element radiation pattern, and thus can be used in an antenna array for suppressing the grating lobes.

Figure 2A:
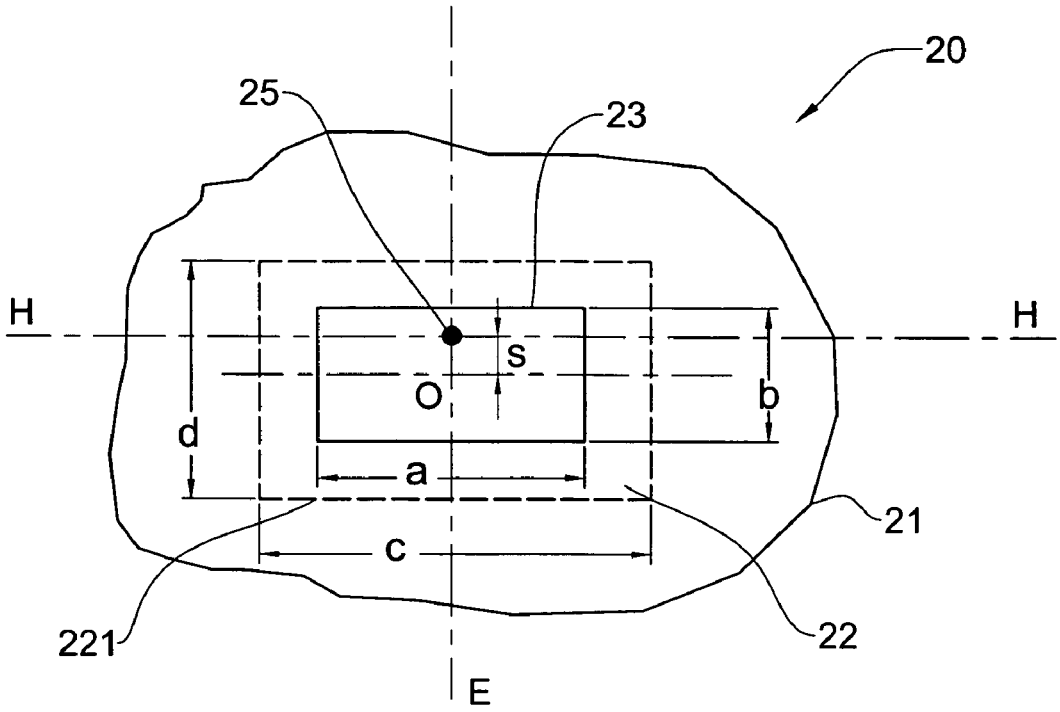
FIG. 2A is a schematic plan view of an antenna element, according to one embodiment of the invention.
Figure 2B:
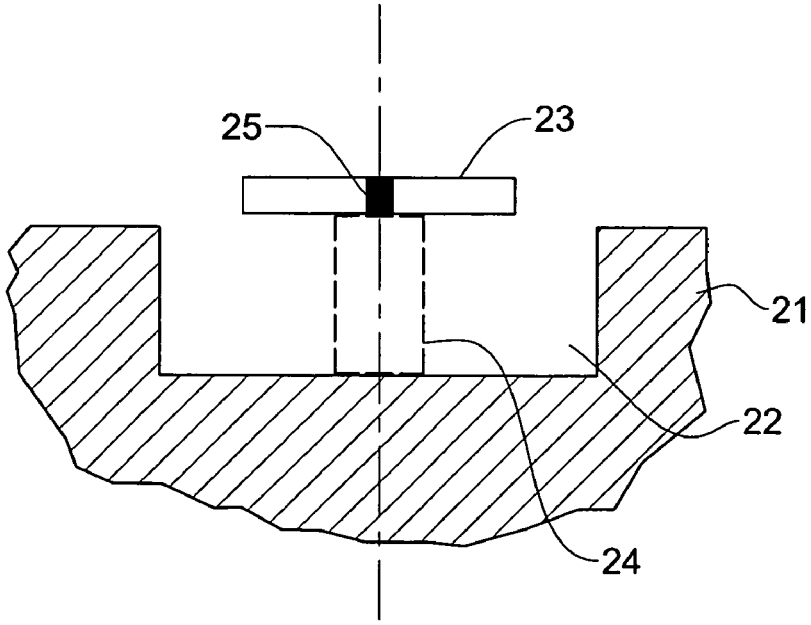
FIG. 2B is a schematic cross-sectional view of the antenna element shown in FIG. 2A.

Referring to FIGS. 2A and 2B, exemplary structures of an antenna element 20 of the present invention are schematically illustrated. More particularly, FIG. 2A is a schematic plan view of the antenna element 20, whereas FIG. 2B is a schematic cross-sectional view of the antenna element 20, taken across the line H-H of FIG. 2A, according to an embodiment of the invention. It should be noted that these figures as well as further figures (illustrating other examples of the antenna element of the present invention) are not to scale, and are not in proportion, for purposes of clarity.

The antenna element 20 includes an "infinite" conductive ground plane 21 having a cavity 22 recessed therein, a radiating patch 23 backed by the cavity 22 and arranged in a cavity aperture 221, and a feed arrangement shown schematically by a reference numeral 24. The feed arrangement 24 is coupled to the radiating patch 23 at a feed point 25 located within the patch 23 for providing radio frequency energy thereto. Various examples of implementation of the feed arrangement 24 will be shown hereinbelow. Preferably, but not mandatory, the radiating patch 23 is centered in the cavity aperture 221.

There is a wide choice of materials available suitable for the antenna element 20. The radiating patch 23 is generally made of conductive material. Examples of the conductive material suitable for the radiating patch 23 include, but are not limited to, copper, gold and their alloys. The radiating patch 23 is selected to be rather thin, such that the patch thickness t is much less than λ ($t \ll \lambda$), where λ is the free-space operating wavelength. The conductive ground plane 21 can, for example, be formed from aluminum to provide a lightweight structure, although other materials, e.g., zinc plated steel, can also be employed.

A plane perpendicular to the radiating patch 23 and passing through a center of the patch and the feed point 25 defines an electric field plane (E-plane) of the patch antenna element 20, whereas a plane perpendicular to the E-plane and passing through the feed point 25 defines a magnetic field plane (H-plane) of the patch antenna element 20.

According to the invention, dimensions of the radiating patch 23 along the E-plane and H-plane are less than the dimensions of the cavity aperture 221. According to the embodiment shown in FIG. 2A, the radiating patch 23 has a rectangular shape with the length a along the H-plane and width b along the E-plane. For example, the length b can be in the range of about 0.2 to 0.7 λ.

In turn, a shape of the cavity aperture 221 is also rectangular. The borders of the cavity aperture 221 are shown by dashed line in FIG. 2A, where the length along the H-plane and width along the E-plane of the cavity aperture 221 are denoted by c and d, respectively.

According to this embodiment, the feed point 25 is located at a position apart by a predetermined distance S from the center O of the patch 23 along the E-plane. The magnitude of the distance S is such so to provide impedance matching of the antenna element.

The inventors have found that although the structure of the patch antenna element 20 has a symmetrical shape, nevertheless at certain circumstances the radiation pattern of the antenna element 20 can be asymmetrical. This new effect of the structure of the antenna element of the invention appears at certain values of the increments A=c_a and B=d_b. Thus, A and B determine the character of the radiation pattern produced by the patch antenna element 20. More particularly, the increment B has to be greater than a certain first predetermined value V1 in order that the radiation pattern of the antenna element 20 would be asymmetrical, though the rate of the asymmetry is independent of the value of the increment B. When B<V1, the radiation pattern remains to be symmetrical. On the other hand, the rate of the asymmetry depends on the value of the increment A. Depending on the requirements, the value of the increment A can always be set to a second predetermined value V2 to achieve a required degree of asymmetry of the element radiating pattern.

It should be noted that the value of V2 depend on A/λ, while the value of V1 depend on B/λ. For example, V1=5 mm and V2=1 mm when the increments A=10 mm and B=16 mm, and the wavelength λ=85.65 mm.

Figure 7:
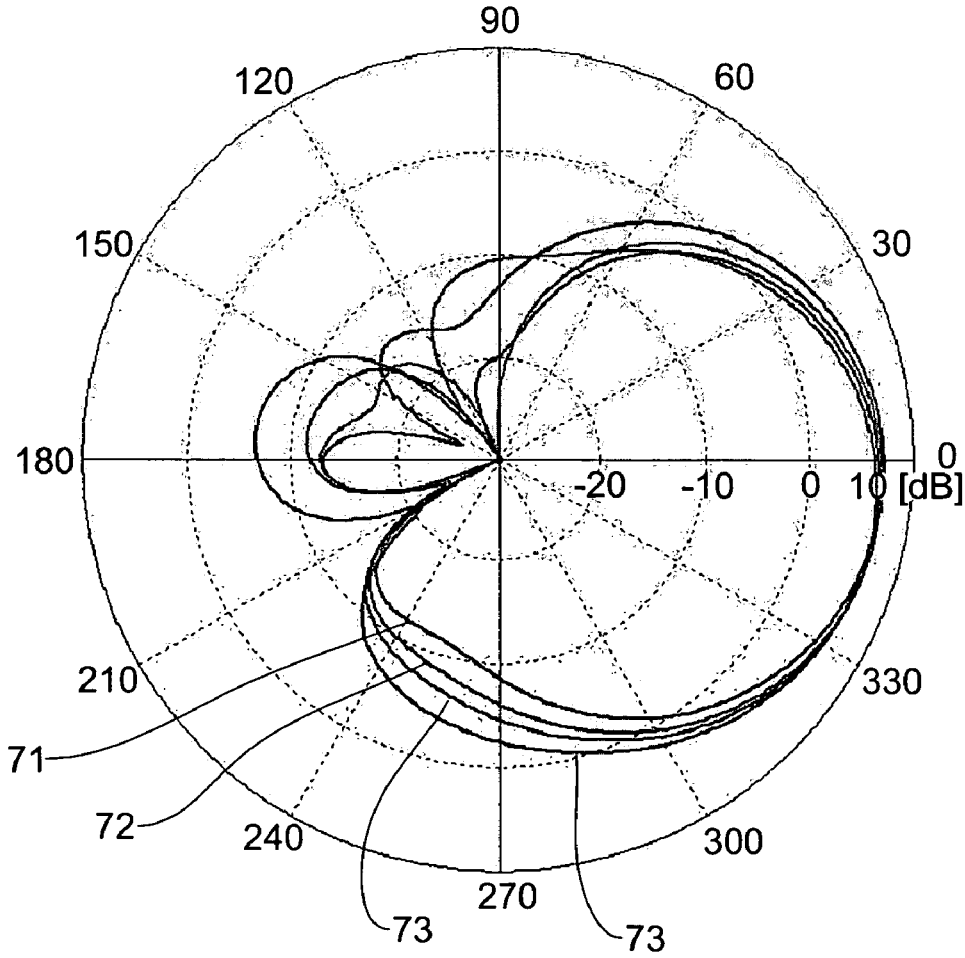
FIG. 7 illustrates a front to back cut of exemplary radiation patterns in E-plane for the antenna element of the present invention.
Figure 8:
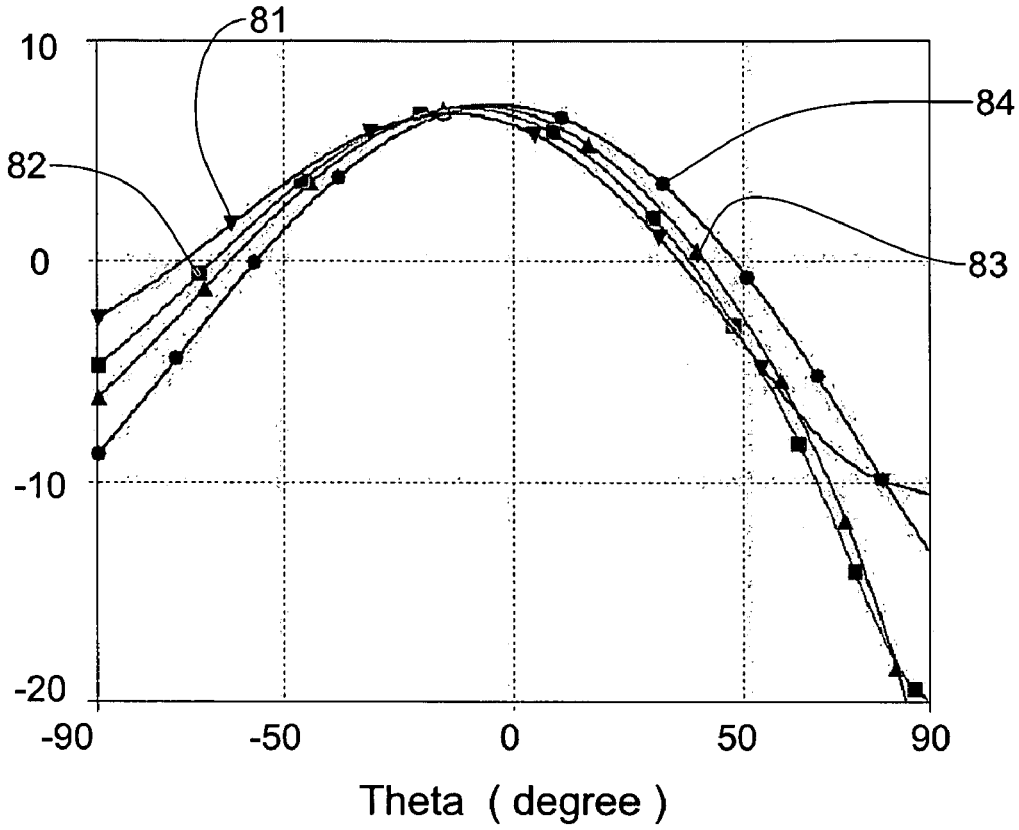
FIG. 8 illustrates an exemplary gain-elevation relation in E-plane for the antenna element of the present invention.

FIG. 7 and FIG. 8 illustrate a front to back cut of exemplary radiation patterns and a gain-elevation relation, respectively, in E-plane obtained by simulation for the antenna element of the present invention operating at 3.5 GHz. The length a of the radiation patch was set to 45 mm. The following values of the increment A were selected for the simulation: 2 mm (curves 71 and 81), 6 mm (curves 72 and 82), 10 mm (curves 73 and 83), and 14 mm (curves 74 and 84). In turn, the width b of the radiating patch was set to 29 mm, whereas the value of the increment B was set to 16 mm that is greater than the threshold value V1=5 mm. As can be seen, when the increment A increases the asymmetry ration of the radiation pattern also increases.

The analysis of the radiation properties of antenna element of the present invention at various frequencies has shown that the asymmetrical antenna pattern of the antenna element of the present invention is relatively insensitive to frequency changes, when compared, for example, to the element radiation pattern of the asymmetrical antenna element described in U.S. Pat. No. 5,006,857.

Figure 3A:
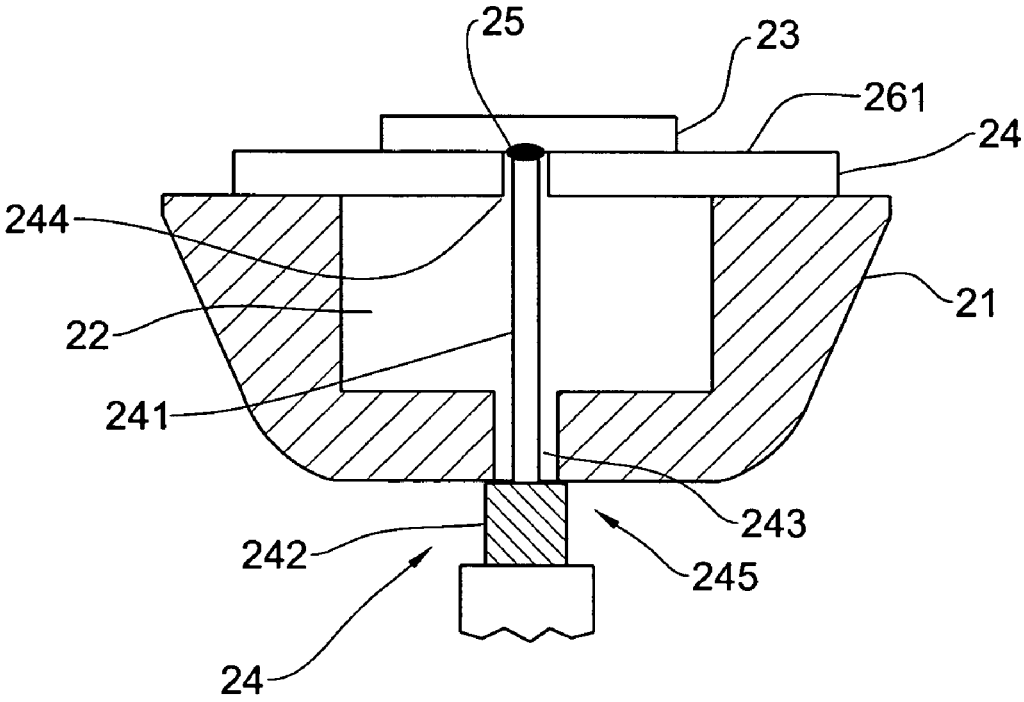
FIGS. 3A-3C illustrate various examples of implementation of a feed arrangement for the antenna element of the present invention.
Figure 3B:
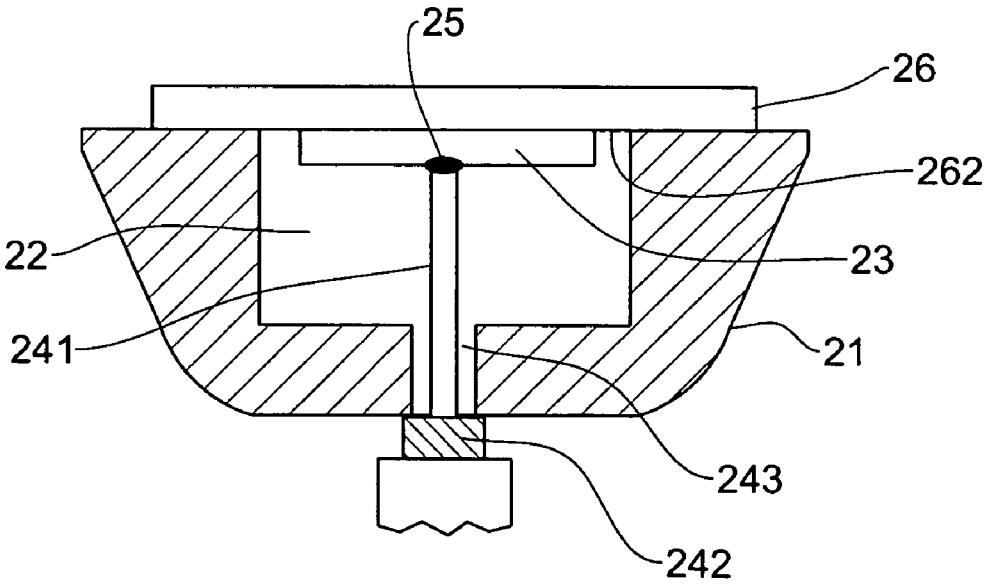

Referring to FIG. 3A and FIG. 3B, two examples of implementation of the feed arrangement 24 for the antenna element 20 are illustrated. According to these examples, the antenna element 20 further includes a dielectric substrate 26 supported on the ground plane 21, which has an outer major side 261 and an inner major side 262. The radiating patch 23 is formed on either major side of a dielectric substrate 26, according to the detailed antenna design.

For example, the radiating patch 23 can be etched on the surface of the dielectric substrate 26 by using a conventional photolithography technique. In particular, the radiating patch 23 can be formed on the outer major side 261 (as shown in FIG. 3A). According to this embodiment of the invention, the feed arrangement 24 includes a vertical coaxial line (vertical probe) 245 having an inner conductor 241 and an outer conductor 242. The inner conductor 241 is extended through an opening 243 in the conductive ground plane 21, the cavity 22 and an opening 244 in the dielectric substrate 26, and electrically connected to the radiating patch 23 at the feed point 25. When required, the outer conductor 242 is connected to the ground plane 21.

Alternatively, the radiating patch 23 can be formed on the inner major side 262 (as shown in FIG. 3B). According to this embodiment, the inner conductor 241 of the vertical feed coaxial line is extended through an opening 243 in the conductive ground plane 21 and the cavity 22, and electrically connected to the radiating patch 23 printed on the inner major side 262 at the feed point 25, whereas the outer conductor 242 can be connected to the ground plane 21.

Figure 3C:
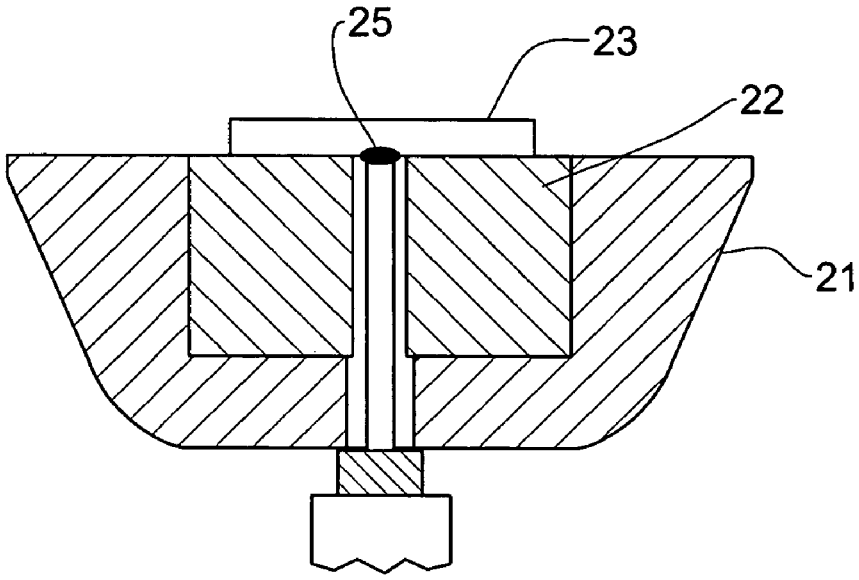

Referring to FIG. 3C, another example of implementation of the antenna element 20 is illustrated. According to this example, the cavity 22 recessed in the ground plane 21 is filled with a solid dielectric material having a predetermined dielectric permittivity $\in$, thereby to form a substrate 263 for supporting the radiating patch 23 thereon. For example, the relative dielectric permittivity $\in$ can be in the range of about 1 to 100. According to this embodiment, the inner conductor 241 of the vertical feed coaxial line 245 is extended through an opening 243 in the conductive ground plane 21 and the cavity 22 filled with the dielectric material, and electrically connected to the radiating patch 23 mounted on substrate 263 at the feed point 25, whereas the outer conductor 242 can be connected to the ground plane 21.

Figure 4:
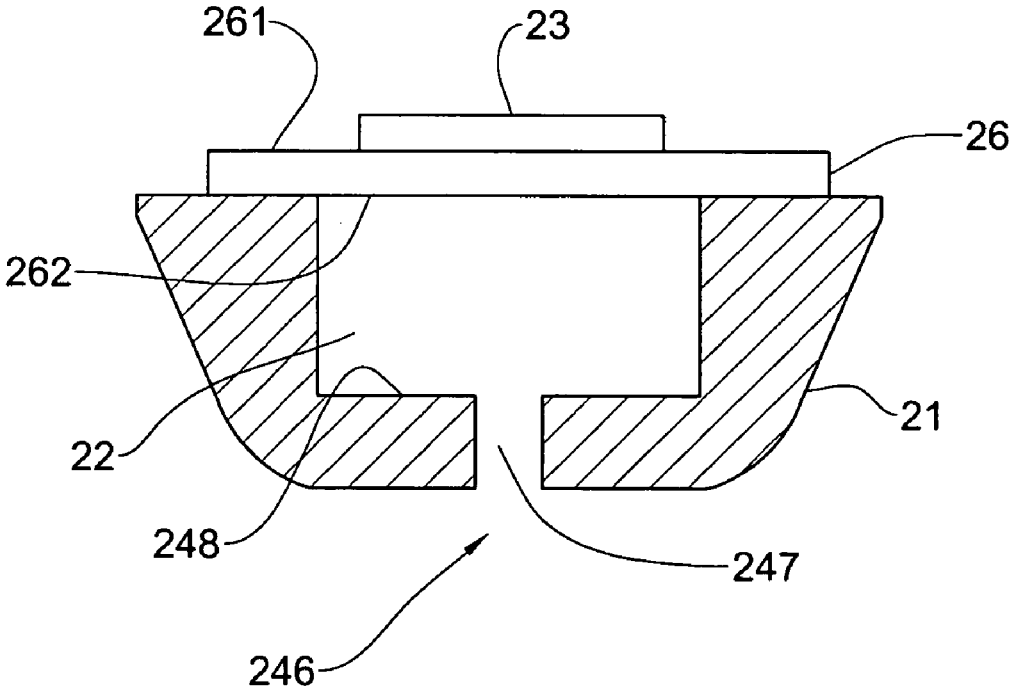
FIG. 4 illustrates a further example of implementation of the feed arrangement for the antenna element of the present invention.

Referring to FIG. 4, further example of implementation of the feed arrangement 24 for the antenna element of the present invention is illustrated. According to this example, the feed arrangement 24 includes a slot coupled feed line 246 having a coupling slot 247 arranged in the conductive ground plane 21 at a bottom 248 of the cavity 22. The radio frequency energy can be provided to the coupling slot 247 by any known manner, for example, the slot coupled feed line 246 can include a waveguide (not shown) or a microstrip line (not shown).

The amount of non-contacting coupling from the slot coupled feed line 246 to the patch 23 is determined by the shape, size and location of the aperture. According to this embodiment, the coupling slot 247 is rectangular and centered under the rectangular radiating patch, leading to lower cross-polarization due to symmetry of the configuration. It should be understood by a person versed in the art that the invention is compatible also with multislot feed arrangements. In addition, slots may generally be any shape that provides adequate coupling between the slot coupled feed line 246 and the patch 23, such as polygonal, circular and/or elliptical.

As shown in FIG. 4, the patch 23 is mounted on the outer major side 261 of the dielectric substrate. However, as can be understood by a person versed in the art, the slot coupled feed line can be provided mutatis mutandis for the antenna configurations when the patch 23 is mounted on the inner major side 262 of the dielectric substrate 26, and for the case when the cavity 22 is filled up with the dielectric material and the patch 23 is mounted on the top thereof.

Figure 5A:
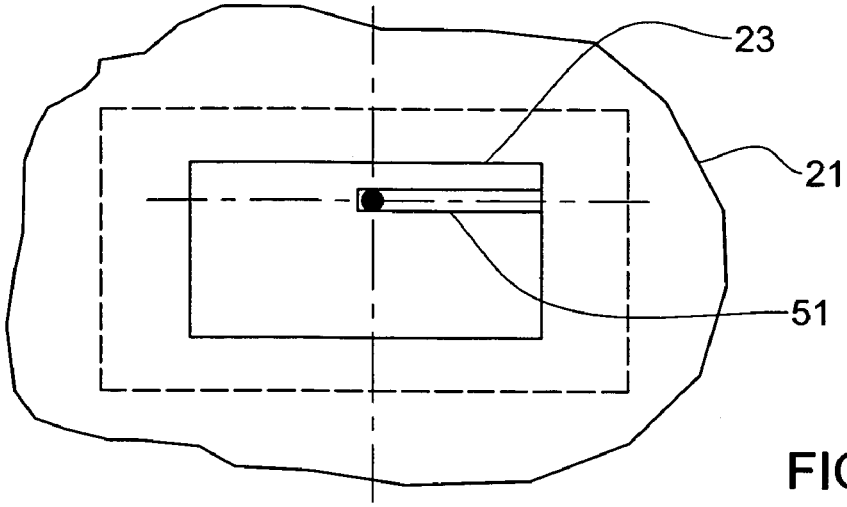
FIG. 5A illustrates a plan view of the antenna element 20 of the present invention, according to yet further example of implementation of the feed arrangement.
Figure 5B:
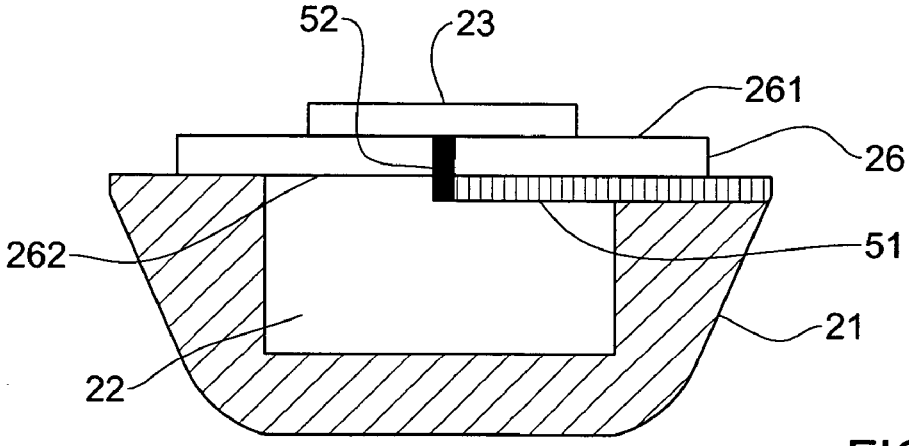
FIG. 5B and FIG. 5C illustrate a cross-sectional view through H-H of FIG. 5A of two example of the antenna element of the present invention.

Referring to FIG. 5A and FIG. 5B, there is shown a plan view and a cross-sectional view (through H-H of FIG. 5A) of the antenna element 20 of the present invention, according to yet further example of implementation of the feed arrangement 24. According to this example, the antenna element 20 includes the radiating patch 23, supported on the outer major side 261 of the dielectric substrate 26 and a proximity coupled feed line 51 mounted on the inner major side 262 of the dielectric substrate 26.

According to the embodiment shown in FIG. 5A and FIG. 5B, the feed arrangement 24 is in the form of a microstrip feed line 51. The radiating patch and the microstrip feed line 51 can be printed by standard techniques onto the dielectric substrate 26, and can, for example, be manufactured in one process. The microstrip feed line can be fed from a cable (not shown), and can be of a form such that it provides a suitable matching circuit between the cable and the patch. For example, the cable can be a semi-rigid coaxial cable that can be soldered to the microstrip metal, which is typically a copper alloy, at the place under the feed point 25.

There are basically two possibilities of coupling the proximity coupled feed line 51 to the radiating patch 23, such as directly contacting and non-contacting. In one scheme, the feed line 51 is connected directly to the radiating patch 23 by means of a plated via 52 or similar. FIG. 5B shows an example of how the microstrip feed line formed on one side of the substrate 26 can be connected to the patch 23 arranged on the other side of the substrate 26 by using a via 52. The via 52 can, for example, be in the form of an empty bore drilled through the substrate 24 and having a conductive cover on the internal surface of the bore. Alternatively, the bores may be filled with a conductive material, e.g. with metal pins.

In the other coupling scheme (not shown), electromagnetic field coupling can be used to transfer RF energy between the proximity coupled feed line 51 and the radiating patch 23.

Figure 5C:
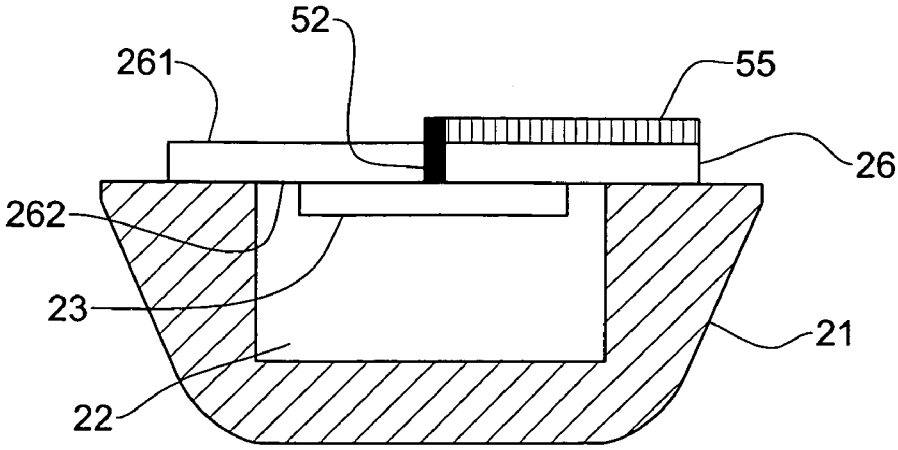

FIG. 5C shows a cross-sectional view of the antenna element 20 according to still further example, in which the feed arrangement 24 is implemented in the form of a proximity coupled feed line 55. According to this example, the radiating patch 23 is supported on the inner major side 262 of the dielectric substrate 26 whereas the proximity coupled feed line 55 is mounted on the outer major side 261 of the dielectric substrate 26. As can be understood, the contacting scheme through a via 52 and non-contacting coupling scheme (not shown) can be used for feeding the antenna element 20, as described above.

Figure 6:
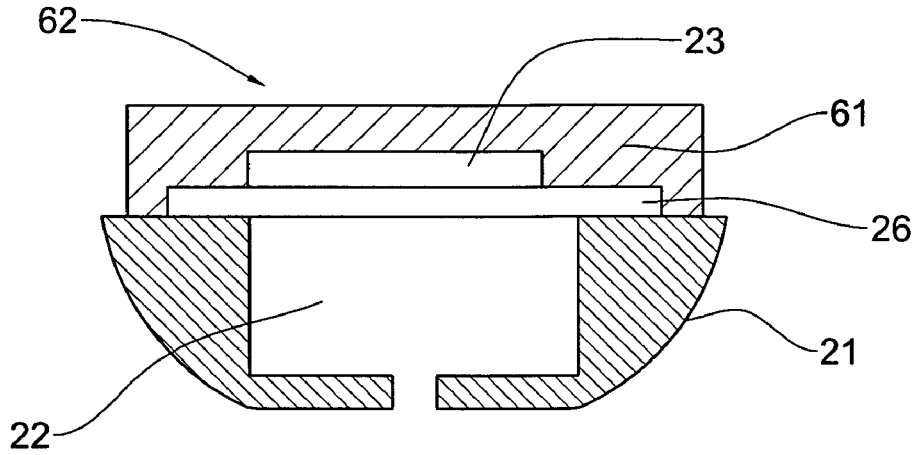
FIG. 6 illustrates a schematic cross-sectional view of an antenna element, according to still a further embodiment of the present invention.

Referring to FIG. 6, a cross-sectional view of an antenna element is illustrated, according to still a further embodiment of the present invention. According to this embodiment, the antenna element 20 further includes a protection radome 61 for providing environmental protection against moister etc. The protection radome 61 is arranged directly on an outer radiating surface 62 of the antenna element. By attaching the radome directly to the antenna, there is no space in which moisture could accumulate. Such moisture would affect the performance of the antenna, both in electrical terms and also in terms of corrosion resistance.

As shown in FIG. 6, the protection radome 61 is mounted on the top of the patch 23 when the patch is printed on the outer major side 261 of the dielectric substrate 26. However, as can be understood by a person versed in the art, the radome 61 can be provided for any kind of feed arrangement 24 and arranged on the outer radiating surface of the antenna mutatis mutandis for the antenna configuration when the patch 23 is mounted on the inner major side 262 of the dielectric substrate 26, and for the case when the cavity 22 is filled up with the dielectric material and the patch 23 is mounted on the top thereof.

The radome 61 can be manufactured by using a suitable dielectric material, such as glass fibre reinforced plastics and/or ABS plastics. Likewise, the radome 61 can be shaped to conform with the radiating elements and can be colored to provide an aesthetically pleasing cover. This cover can also act as a solar shield to reduce the effects of solar radiation heating and an impact shield to prevent mechanical damage to the base station electronics.

When required, the construction may further provide environmental sealing for the antenna element to prevent performance degradation of the antenna element during its lifetime due to moisture induced corrosion etc.

Figure 9:
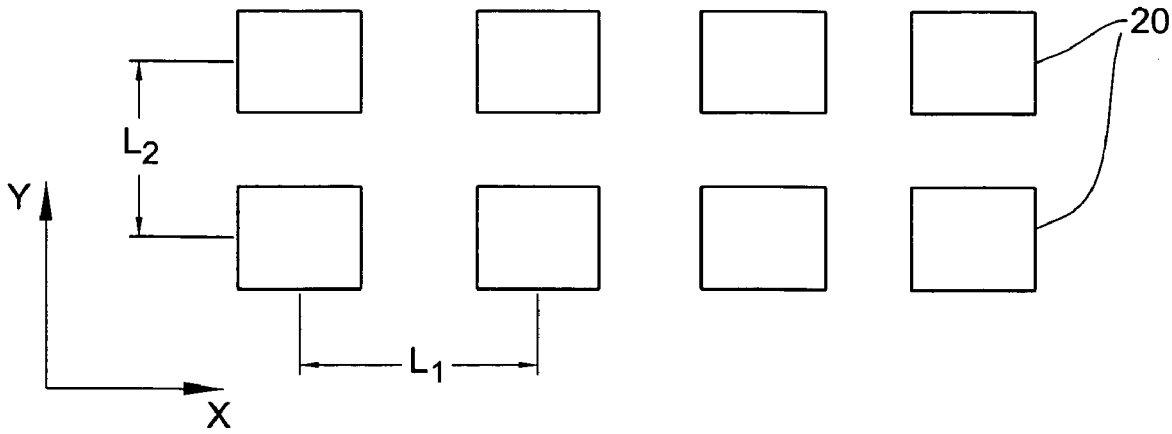
FIG. 9 illustrates a partial front view of an exemplary phased array antenna comprising a plurality of cavity-backed patch antenna elements of the present invention.

The single antenna element 20 described above, can be implemented in an array structure of a linear or planar form, taking the characteristics of the corresponding array factor. FIG. 9 shows a partial front view of an exemplary phased array antenna 90 comprising a plurality of cavity-backed patch antenna elements 20 spaced apart at a predetermined distances L1 and L2 from each other along system axes x and y, correspondingly. For example, the predetermined distances L1 and L2 between the patch antenna elements can be in the range of quarter-wavelength to one-wavelength. It should be noted that depending on the requirements, the distances L1 and L2 can be equal or different. Furthermore, when required, the array antenna 90 can be monolithically co-integrated on-a-chip together with other elements (e.g. DSP-driven switches) and can also radiate steerable multi-beams, thus making the whole array a smart antenna.

As described above and shown in FIGS. 1A and 1B, due to the fact that the antenna element pattern is asymmetrical, the grating lobes which might appear in the visible zone can be suppressed in the entire pattern of the phased array antenna 90.

It can be appreciated by a person of the art that the patch antenna element of the present invention may have numerous applications. The list of applications includes, but is not limited to, various devices operating in the frequency band of about 100 MHz to 500 GHz. In particular, the patch antenna element of the present invention would be operative with radars, telemetry stations, jamming stations, communication devices (e.g., mobile phones, PDAs, remote control units, telecommunication with satellites, etc.), etc.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

It is apparent that the antenna of the present invention is not bound to the examples of the rectangular patch and cavity aperture. In principle, the patch and the cavity aperture may have a different configuration than rectangular. It could be generally polygonal, circular, elliptical or otherwise symmetrical with regard to the center of the patch and cavity aperture.

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims.

The invention claimed is:

1. A patch antenna element comprising:

a conductive ground plane having a cavity recessed therein and defining a cavity aperture, a radiating patch backed by the cavity and arranged in the cavity aperture, and a feed arrangement coupled to the radiating patch at a feed point located within the patch and operable to provide radio frequency energy thereto;

the patch antenna element being configured such that a dimension of the radiating patch along an E-plane defined as a plane perpendicular to the radiating patch and passing through a center of the patch and the feed point, is less than the dimension of the cavity aperture along the E-plane by a first predetermined value, said first predetermined value being selected such to provide an asymmetrical radiation pattern of said patch antenna element, wherein said feed point is located at a position apart by a predetermined distance from the center of the patch along the E-plane.

2. The patch antenna element of claim 1, wherein a dimension of the radiating patch along the H-plane defined as a plane perpendicular to the E-plane and passing through the feeding point, is less than the dimension of the cavity aperture along said H-plane by a second predetermined value, said second predetermined value (V2) being selected such to provide a required degree of the asymmetry of said radiation pattern.

3. The patch antenna element of claim 1 wherein the radiating patch and the cavity aperture have symmetrical shapes selected from polygonal shape, circular shape and elliptical shape.

4. The patch antenna element of claim 1 wherein said radiating patch is formed on a dielectric substrate having an outer major side and an inner major side facing the conductive ground plane and supported thereon.

5. The patch antenna element of claim 4 wherein said radiating patch is formed on said outer major side of the dielectric substrate.

6. The patch antenna element of claim 4 wherein said radiating patch is formed on said inner major side of the dielectric substrate.

7. The patch antenna element of claim 6 wherein said feed arrangement includes a proximity coupled feed line.

8. The patch antenna element of claim 7 wherein said proximity coupled feed line includes a microstrip feed arranged on the other major side of the dielectric substrate than the major side on which the radiating patch is formed.

9. The patch antenna element of claim 1 wherein said cavity is filled with a dielectric material.

10. The patch antenna element of claim 9 wherein said dielectric material is made of a solid material forming a substrate for supporting said radiating patch thereon.

11. The patch antenna element of claim 1 wherein said feed arrangement includes a vertical coaxial line having an inner conductor and an outer conductor, said inner conductor being extended through an opening in the conductive ground plane and cavity, and coupled to the radiating patch at the feed point, whereas said outer conductor being coupled to the ground plane.

12. The patch antenna element of claim 1 wherein said feed arrangement includes a slot coupled feed line made through a slot arranged in said conductive ground plane at a bottom of the cavity.

13. The patch antenna element of claim 1 further comprising a protection radome formed on an outer radiating surface of the patch antenna element.

14. A patch antenna element comprising:

a conductive ground plane having a cavity recessed therein and defining a cavity aperture, a radiating patch backed by the cavity and arranged in the cavity aperture, and a feed arrangement coupled to the radiating patch at a feed point located within the patch and operable to provide radio frequency energy thereto;

the patch antenna element being configured such that a dimension of the radiating patch along an E-plane defined as a plane perpendicular to the radiating patch and passing through a center of the patch and the feed point, is less than the dimension of the cavity aperture along the E-plane by a first predetermined value, said first predetermined value being selected such to provide an asymmetrical radiation pattern of said patch antenna element, wherein the gain of said predetermined asymmetrical radiation pattern decreases by less than 6 dB of its maximum value from boresight to a point 77° from boresight in a selected direction.

15. A phased array antenna comprising a plurality of patch antenna elements, each patch antenna element comprising:

a conductive ground plane having a cavity recessed therein and defining a cavity aperture, a radiating patch backed by the cavity and arranged in the cavity aperture, and a feed arrangement coupled to the radiating patch at a feed point located within the patch and operable to provide radio frequency energy thereto;

the patch antenna element being configured such that a dimension of the radiating patch along an E-plane defined as a plane perpendicular to the radiating patch and passing through a center of the patch and the feed point, is less than the dimension of the cavity aperture along the E-plane by a first predetermined value, said first predetermined value being selected such to provide an asymmetrical radiation pattern of said patch antenna element;

said patch antenna elements being spaced apart at a predetermined distance from each other; and a beam steering system configured for steering an energy beam produced by said phased array antenna.

16. The phased array antenna of claim 15 wherein said predetermined distance between the patch antenna elements is in the range of quarter-wavelength to one-wavelength.

17. The phased array antenna of claim 15 being configured for scanning within the range of $-50° < \theta < +77°$, where $\theta$ is the scanning angle from boresight towards endfire.

18. A method of suppressing grating lobes generated in a radiating pattern of a phased array antenna, the method comprising forming the phased array antenna from a plurality of symmetrical antenna elements spaced apart at a predetermined distance from each other, each symmetrical antenna element producing an asymmetrical radiation pattern, the method thereby enabling to extend a scanning angle of a steered energy beam of said phased array antenna.

19. The method of claim 18 wherein said plurality of antenna elements includes at least one antenna element of claim 1.

20. The method of claim 18 wherein said scanning angle is in the range of −50° to +77° from boresight towards endfire.

* * * * *